US009107519B2

(12) United States Patent
Clark et al.

(10) Patent No.: US 9,107,519 B2
(45) Date of Patent: Aug. 18, 2015

(54) PORTABLE SLEEPING ASSEMBLY

(71) Applicants: Elyse Clark, Newtown, CT (US); Kelley Ann Foley, Danbury, CT (US)

(72) Inventors: Elyse Clark, Newtown, CT (US); Kelley Ann Foley, Danbury, CT (US)

( * ) Notice: Subject to any disclaimer, the term of this patent is extended or adjusted under 35 U.S.C. 154(b) by 0 days.

(21) Appl. No.: 14/139,192

(22) Filed: Dec. 23, 2013

(65) Prior Publication Data

US 2015/0143635 A1 May 28, 2015

Related U.S. Application Data

(60) Provisional application No. 61/908,381, filed on Nov. 25, 2013.

(51) Int. Cl.

| | |
|---|---|
| ***A47C 17/86*** | (2006.01) |
| ***A47G 9/08*** | (2006.01) |
| *A47G 9/02* | (2006.01) |
| *A47G 9/06* | (2006.01) |

(52) U.S. Cl.

CPC .. *A47G 9/08* (2013.01); *A47G 9/02* (2013.01); *A47G 9/06* (2013.01); *A47G 9/0207* (2013.01); *A47G 9/0223* (2013.01); *A47G 9/062* (2013.01)

(58) Field of Classification Search

CPC ..... A47G 9/02; A47G 9/0207; A47G 9/0223; A47G 9/0246; A47G 9/06; A47G 9/062; A47G 9/064; A47G 9/066; A47G 9/08; A47G 9/083; A47G 9/086

USPC ..... 5/413 R, 413 AM, 417, 419, 420, 482, 5/487, 485, 496, 498

See application file for complete search history.

(56) References Cited

U.S. PATENT DOCUMENTS

| | | | | | |
|---|---|---|---|---|---|
| 4,723,300 | A * | 2/1988 | Aranow | 383/4 |
| 4,984,906 | A * | 1/1991 | Little | 383/4 |
| 5,099,530 | A * | 3/1992 | Scott | 5/420 |
| 5,457,829 | A * | 10/1995 | Elliott | 5/420 |
| 5,611,414 | A * | 3/1997 | Walker | 190/2 |
| D382,755 | S * | 8/1997 | Knopfler | D6/596 |
| 5,720,057 | A * | 2/1998 | Duncan | 5/420 |
| 5,740,567 | A * | 4/1998 | Mitchell | 5/420 |
| 5,887,300 | A * | 3/1999 | Pond | 5/420 |
| 6,065,164 | A * | 5/2000 | Swanger et al. | 5/420 |
| 6,141,805 | A * | 11/2000 | Fisher-Cohen et al. | 5/420 |
| 6,519,793 | B2 * | 2/2003 | Le Gette et al. | 5/417 |
| 6,751,816 | B1 * | 6/2004 | Wechsler | 5/417 |
| 6,792,631 | B1 * | 9/2004 | Hayden | 5/417 |
| 6,799,339 | B2 * | 10/2004 | Stewart | 5/413 AM |
| 6,802,092 | B1 * | 10/2004 | Klein | 5/420 |
| 7,000,270 | B2 * | 2/2006 | Le Gette et al. | 5/417 |
| 7,017,206 | B1 * | 3/2006 | Kedineoglu | 5/417 |
| 7,058,997 | B1 * | 6/2006 | Klinger | 5/413 R |
| 7,591,033 | B2 * | 9/2009 | Theriault | 5/417 |
| 7,621,005 | B1 * | 11/2009 | Harvey | 5/419 |
| 7,810,184 | B2 * | 10/2010 | McCollum | 5/500 |
| 7,849,535 | B2 * | 12/2010 | Tatsuno | 5/413 AM |
| 8,578,526 | B1 * | 11/2013 | Rosso | 5/419 |
| 2004/0107500 | A1 * | 6/2004 | Pigg | 5/413 R |
| 2005/0015880 | A1 * | 1/2005 | Mayes | 5/632 |

(Continued)

*Primary Examiner* — Robert G Santos
*Assistant Examiner* — David E Sosnowski
(74) *Attorney, Agent, or Firm* — Welsh Flaxman & Gitler LLC

(57) ABSTRACT

A portable sleeping assembly includes a mat member having a top and a bottom and four sides. The sleeping assembly also includes a blanket secured to the mat member along two adjacent sides of the mat member, a pillow pocket secured to the top of the mat member, and a pair of spaced storing straps secured to the bottom of the mat member.

14 Claims, 8 Drawing Sheets

(56) References Cited

U.S. PATENT DOCUMENTS

| | | | | |
|---|---|---|---|---|
| 2005/0028277 | A1* | 2/2005 | Gordon et al. | 5/420 |
| 2007/0044236 | A1* | 3/2007 | Tatsuno | 5/420 |
| 2007/0157382 | A1* | 7/2007 | Reeves | 5/482 |
| 2008/0127414 | A1* | 6/2008 | Allen | 5/417 |
| 2009/0044333 | A1* | 2/2009 | Colleran et al. | 5/413 R |
| 2010/0043144 | A1* | 2/2010 | Thompson | 5/485 |
| 2012/0060286 | A1* | 3/2012 | Gendron | 5/500 |
| 2012/0255125 | A1* | 10/2012 | Brown | 5/636 |
| 2014/0000028 | A1* | 1/2014 | Pillay | 5/487 |
| 2014/0059763 | A1* | 3/2014 | Paulat | 5/417 |

* cited by examiner

PORTABLE SLEEPING ASSEMBLY

CROSS REFERENCE TO RELATED APPLICATION

This application claims the benefit of U.S. Provisional Patent Application 61/908,381, entitled "PORTABLE SLEEPING ASSEMBLY," filed Nov. 25, 2013.

BACKGROUND OF THE INVENTION

1. Field of the Invention

The invention relates to a portable sleeping assembly.

2. Description of the Related Art

Children look forward to having sleep overs with friends. The children watch movies, talk, stay up late and enjoy snacks.

Most of the time, the children bring sleeping bags and sleep on the floor in the family room, recreation room, or the friend's bedroom. However, sleeping bags often are constructed for outdoor use and encase the children in a very warm, cocoon type environment. Sleeping bags also do not commonly include padding. For many children this confined sleeping environment is claustrophobic and/or overly warm, as it is very different from the traditional bed environment they are used to when sleeping at home.

As such, a need exists for a sleeping assembly that is both portable and comfortable. The present invention provides such a sleeping assembly.

SUMMARY OF THE INVENTION

It is, therefore, an object of the present invention to provide a portable sleeping assembly including a mat member having a top and a bottom and four sides extending between the top and bottom. The sleeping assembly also includes a blanket secured to the mat member along two adjacent sides of the mat member, a pillow pocket secured to the top of the mat member, and at least one closure strap secured to the bottom of the mat member.

It is also an object of the present invention to provide a portable sleeping assembly wherein the blanket is secured to a portion of a third side.

It is another object of the present invention to provide a portable sleeping assembly wherein a pillow is positioned within the pillow pocket.

It is a further object of the present invention to provide a portable sleeping assembly wherein the blanket and top of the mat are made from a first material and the bottom of the mat is made from a different second material.

It is also an object of the present invention to provide a portable sleeping assembly wherein the first material is minky fleece and the different second material is rip-stop nylon.

It is another object of the present invention to provide a portable sleeping assembly wherein the mat member includes a memory foam core.

It is a further object of the present invention to provide a portable sleeping assembly wherein one side includes a slot permitting the memory foam core to be inserted and removed from the mat member.

It is also an object of the present invention to provide a portable sleeping assembly wherein the slot is a zippered slot.

It is another object of the present invention to provide a portable sleeping assembly wherein the bottom of the mat member further includes a pair of spaced carry straps defining opposed loops.

It is a further object of the present invention to provide a portable sleeping assembly wherein the at least one closure straps includes first and second ends having mating fasteners secured thereto.

It is also an object of the present invention to provide a portable sleeping assembly wherein two of the four sides are short sides opposed from one another and the other two sides are opposed long sides which are longer in length than the short sides.

It is another object of the present invention to provide a portable sleeping assembly wherein the blanket includes an upper surface and a lower surface with a four edges.

It is a further object of the present invention to provide a portable sleeping assembly wherein two adjacent edges of the blanket are secured to the two adjacent sides of the mat member.

It is also an object of the present invention to provide a portable sleeping assembly wherein two edges of the blanket are longer than the short sides of the mat member.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
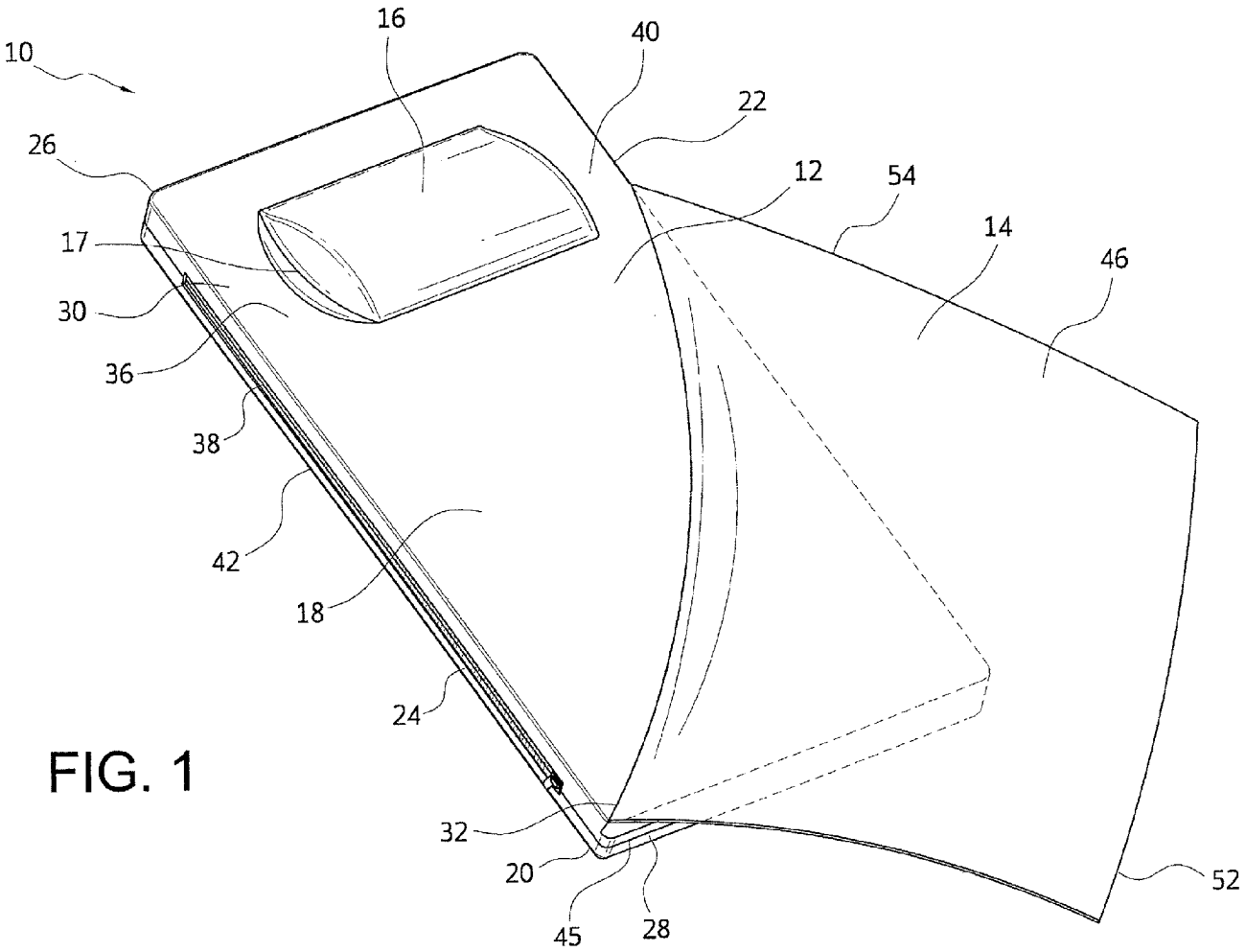
FIG. 1 is a top perspective view of the present portable sleeping assembly with the blanket pulled aside.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

With reference to FIGS. 1 to 9, a portable sleeping assembly 10 is disclosed. The sleeping assembly 10 includes a mat member 12 to which is secured a blanket 14, a pillow pocket 16 and various straps for storage and carrying thereof.

The mat member 12 is substantially rectangular and includes an upper surface 18 and a lower surface 20. The mat member 12 is generally composed of a cover member 36 into which a foam core 34 is selectively positioned for the provision of cushioning during use. It is appreciated the portable sleeping assembly 10 may be sold with the foam core 34 already encased within the cover member 36 or the portable sleeping assembly 10 may be sold without the foam core where space considerations and cost dictate such.

Because the mat member 12 is provided with a thickness once the foam supporting material defining the core thereof is inserted within the cover member 36, the following disclosure described the structure of the mat member 12 once the foam member is inserted within the cover member as is shown in FIGS. 1-6, 8 and 9. The mat member 12 includes a plurality of side walls 22, 24, 26, 28 extending between the upper surface 18 (that is, the top of the mat member 12) and the lower surface 20 (that is, the bottom of the mat member 12). As the mat member 12 is rectangular, it is provided with first and second long side walls 22, 24 and first and second short side walls 26, 28. In accordance with a preferred embodiment, the long side walls 22, 24 are from 54 to 72 inches. in length and short side walls 26, 28 are from 26 to 34 inches in length. It is well appreciated those sleeping on the present portable sleeping assembly 10 will lie lengthwise, that is, with their head adjacent the first short side wall 26 and their feet adjacent the second short side wall 28. As such, and as used herein, the portion of the mat member 12 located adjacent the first short side wall 26 is considered to be the head end 30 of the mat member 12 and the portion of the mat member 12 located adjacent the second short side wall 28 is considered to be the foot end 32 of the mat member 12.

As briefly mentioned above, a foam core 34 is inserted within the cover member 36 of the mat member 12 so as to provide comfort to the user when the mat is lying upon a support surface. In accordance with a preferred embodiment, the foam core 34 is manufactured from memory foam, that is, a viscoelastic polyurethane foam or low-resilience polyurethane foam. While memory foam is used in accordance with a preferred embodiment, it is appreciated other foams and cushioning materials may be used without departing from the spirit of the present invention. In accordance with a preferred embodiment, the foam core 34 has a thickness of 1 to 2.5 inches.

The cover member 36 encases the foam core 34 therein. The cover member 36 is shaped and dimensioned to fit snuggly about the foam core 34. In order to permit cleaning of the cover member 36, it is provided with a zippered slot 38 permitting selective removal of the foam core 34. With the foam core 34 removed, the cover member 36 may be washed, preferably, machine washed.

Enhance comfort and durability is achieved by making the cover member 36 along the lower surface 20 of the mat member 12 from a different material than the cover member 36 along the upper surface 18 of mat member 12. In particular, the upper cover member 40 (that is, the portion of the cover member 36 along the upper surface 18 of the mat member 12) is made of fleece, in particular, minky dot fleece for comfort. The lower cover member 42 (that is, the portion of the cover member 36 along the lower surface 20 of the mat member 12) is made of waterproof rip-stop nylon. The upper cover member 40 and the lower cover member are sewn together along seam 45.

As discussed above, the portable sleeping assembly 10 is provided with a pillow pocket 16. The pillow pocket 16 is positioned at the head end 30 of the mat member 12. In accordance with a preferred embodiment the pillow pocket 16 is fixedly secured to the cover member 36 in the area of the head end 30 of the mat member 12. In particular, the pillow pocket 16 is preferably sewn to the cover member 36. The pillow pocket includes an opening 17 for receipt of a pillow 16*p*.

In addition to the pillow pocket 16, the portable sleeping assembly 10 is provided with a blanket 14. In accordance with a preferred embodiment, the blanket is also made from minky fleece. So that the blanket 14 is not lost and to prevent a user's feet from extending off of the mat member 12, it is fixedly connected to the cover member 36. In particular, the blanket 14 includes an upper surface 44 and a lower surface 46 with a plurality of edges 48, 50, 52, 54 (in accordance with a preferred embodiment, the blanket 14 is provided with 4 edges since it is constructed in a rectangular configuration). As such, the blanket 14 includes a first edge 48, a second edge 50, a third edge 52 and a fourth edge 54.

The blanket 14 is dimensioned to fully cover the individual sleeping in the portable sleeping assembly 10 in much the same way an individual would be covered when sleeping in his or her own bed. With this in mind, the length of the first edge 48 and opposed third edge 52 are shorter than the length of the first and second long side walls 22, 24 and the second edge 50 and opposed fourth edge 54 are longer than the length of the first and second short side walls 26, 28. In this way, the blanket 14 will cover the individual sleeping in the present portable sleeping assembly 10 from a position slightly below the pillow pocket 16 at the head end 30 of the mat member 12 to the foot end 32 of the mat member 12. As for the length of the blanket 14 extending across the mat member 12 it is sufficiently long to extend over an individual with one edge, in particular, the third edge 52, of the blanket 14 extending beyond the second long side wall 24 of the mat member 12. In this way, there is plenty of blanket to cover the individual using the portable sleeping assembly 10 without creating a claustrophobic environment commonly created with sleeping bags.

As briefly mention above, the blanket 14 it fixedly secured via sewing to the cover member 36. In particular, the full length of the first edge 48 is fixedly secured to a portion of the first long side wall 22. The first edge 48 is fixedly secured to the cover member 36 along the first long side wall 22 from a position substantially aligned with the pillow pocket 16 at the head end 30 of the mat member 12 to the foot end 32 of the mat member 12 where the first long side wall 22 meets the second short side wall 28. A portion of the second edge 50 of the blanket 14 is fixedly secured to the cover member 36 along the full length of the second short side wall 28. The second edge 50 is fixedly secured to the second short side wall 28 from a position where the first long side wall 22 meets the second short side wall 28 to a position where the second short side wall 28 meet the second long side wall 24. With these portions of the blanket 14 attached to the cover member 36, the remaining edges 52, 54 of the blanket 14 are free and the individual may easily get into and out of the portable sleeping assembly 10.

Figure 2:
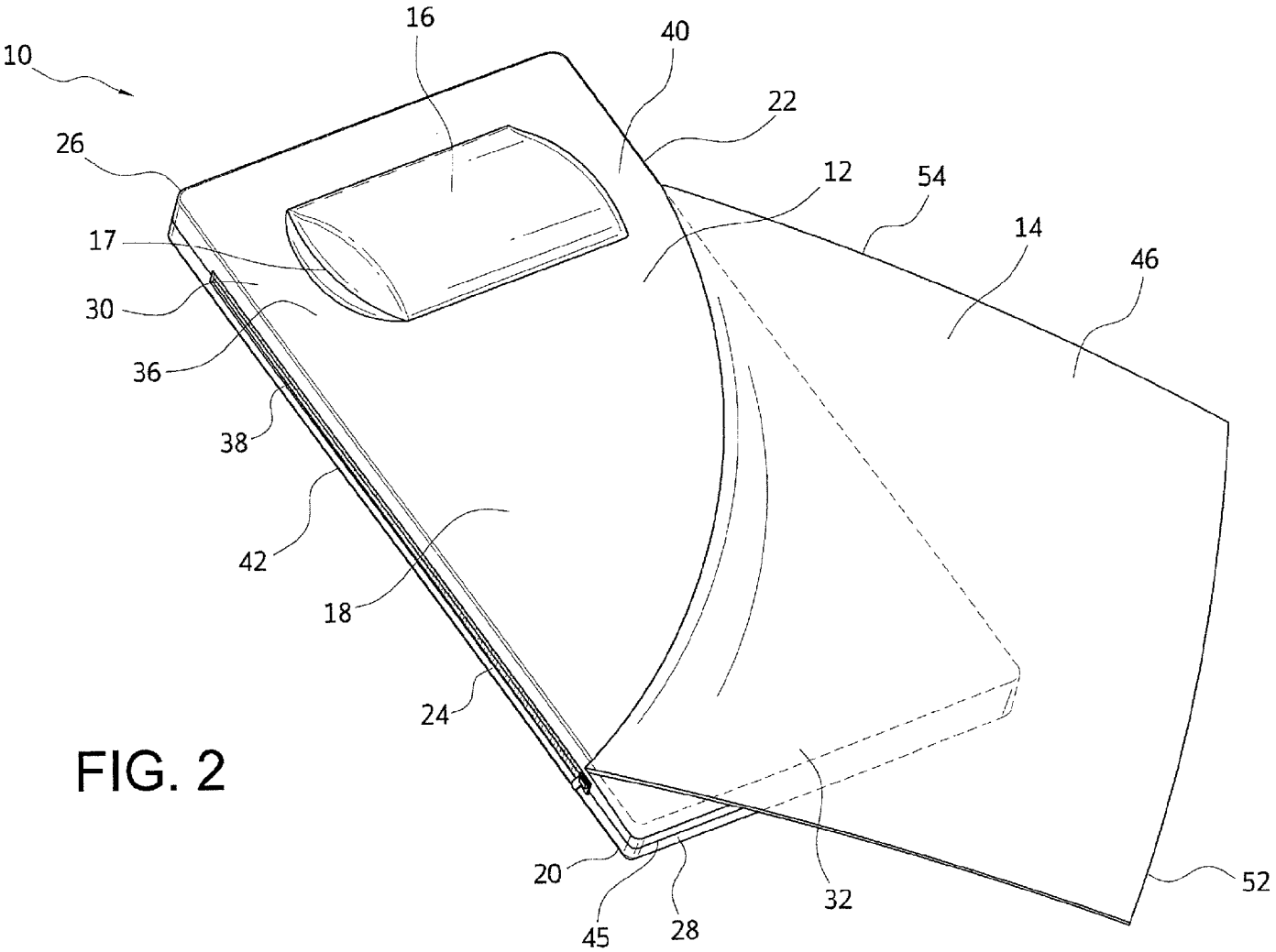
FIG. 2 is a top perspective view of the present portable sleeping assembly in accordance with an alternate embodiment.
Figure 3:
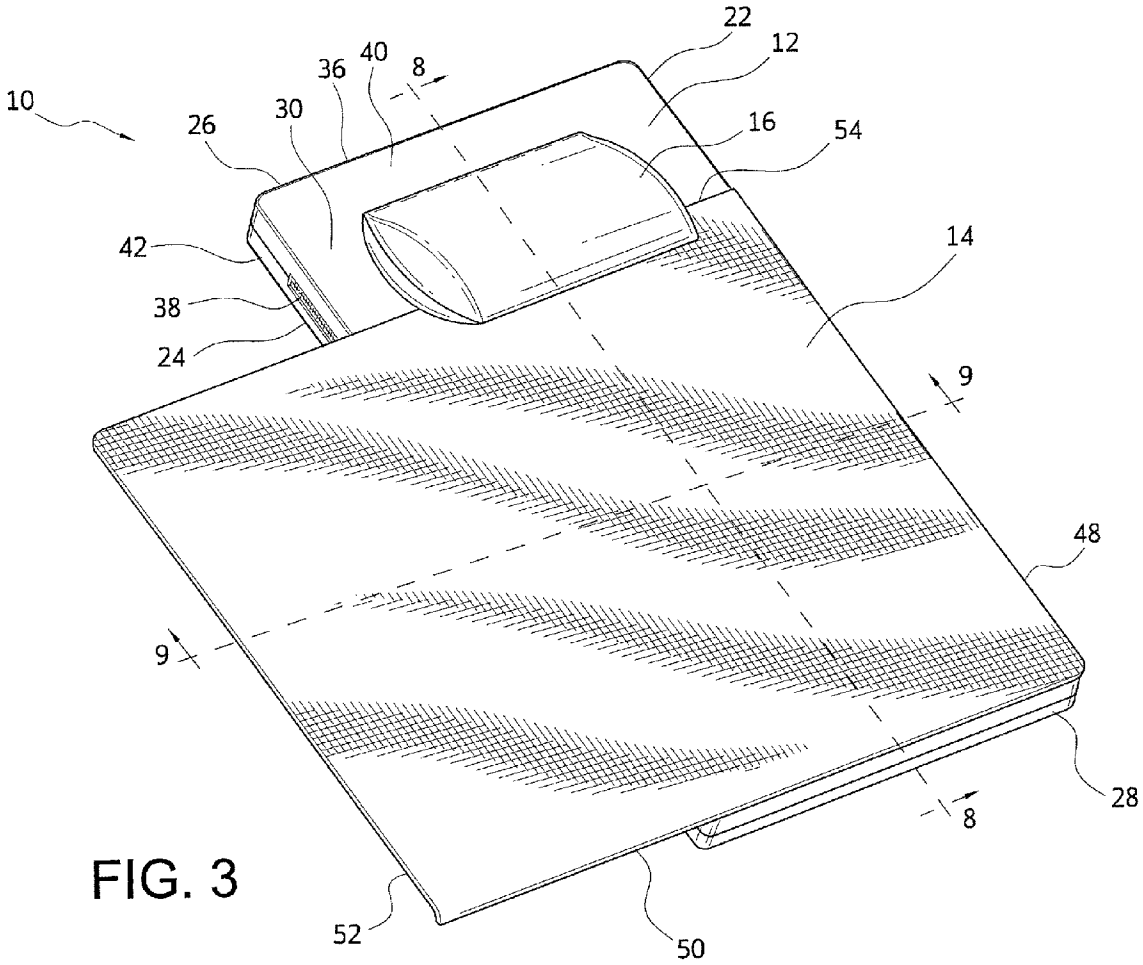
FIG. 3 a top perspective view of the portable sleeping assembly shown with reference to FIG. 1 with the blanket pulled fully across the base cushioning member.
Figure 4:
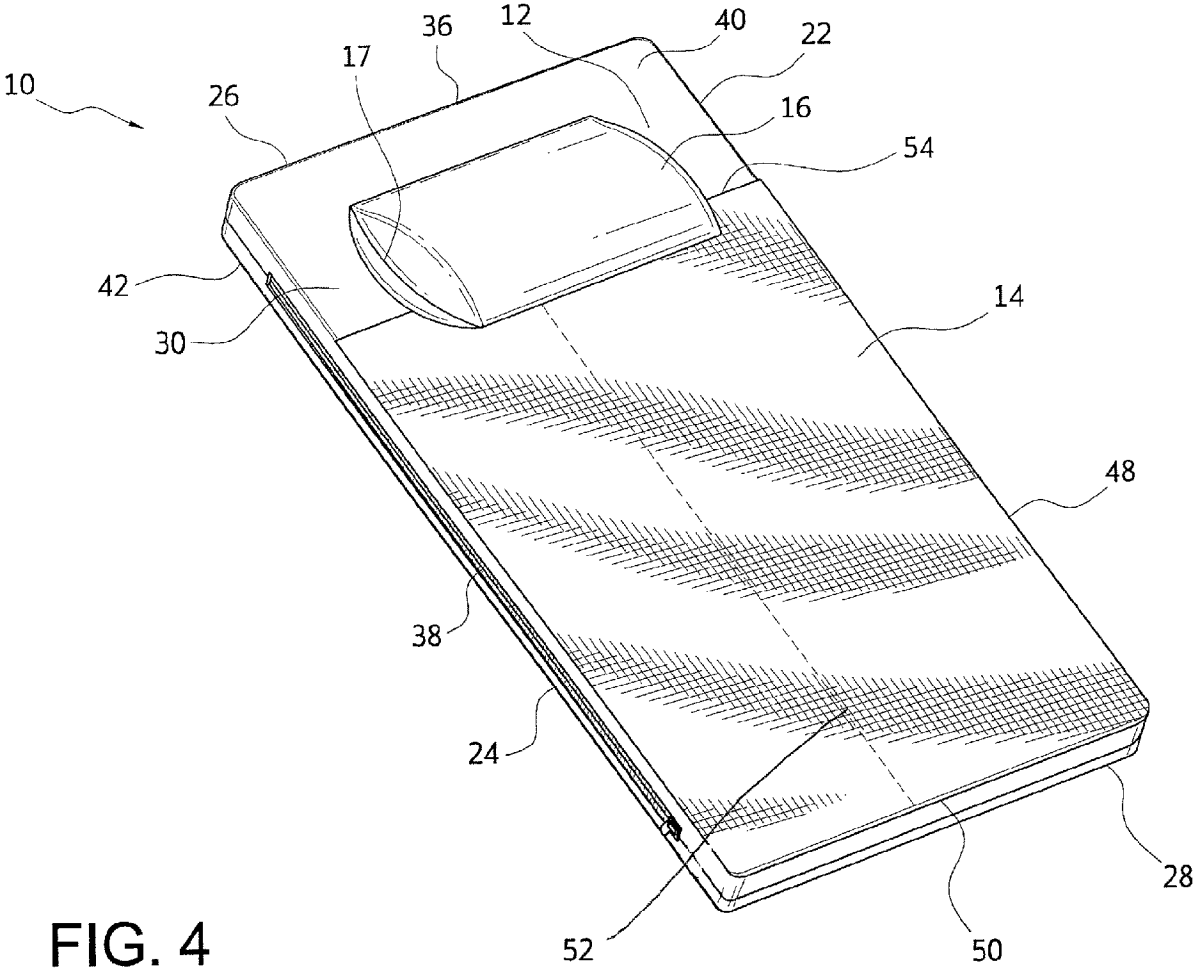
FIG. 4 a top perspective view of the portable sleeping assembly shown with reference to FIG. 1 with the blanket pulled under the base cushioning member.
Figure 5:
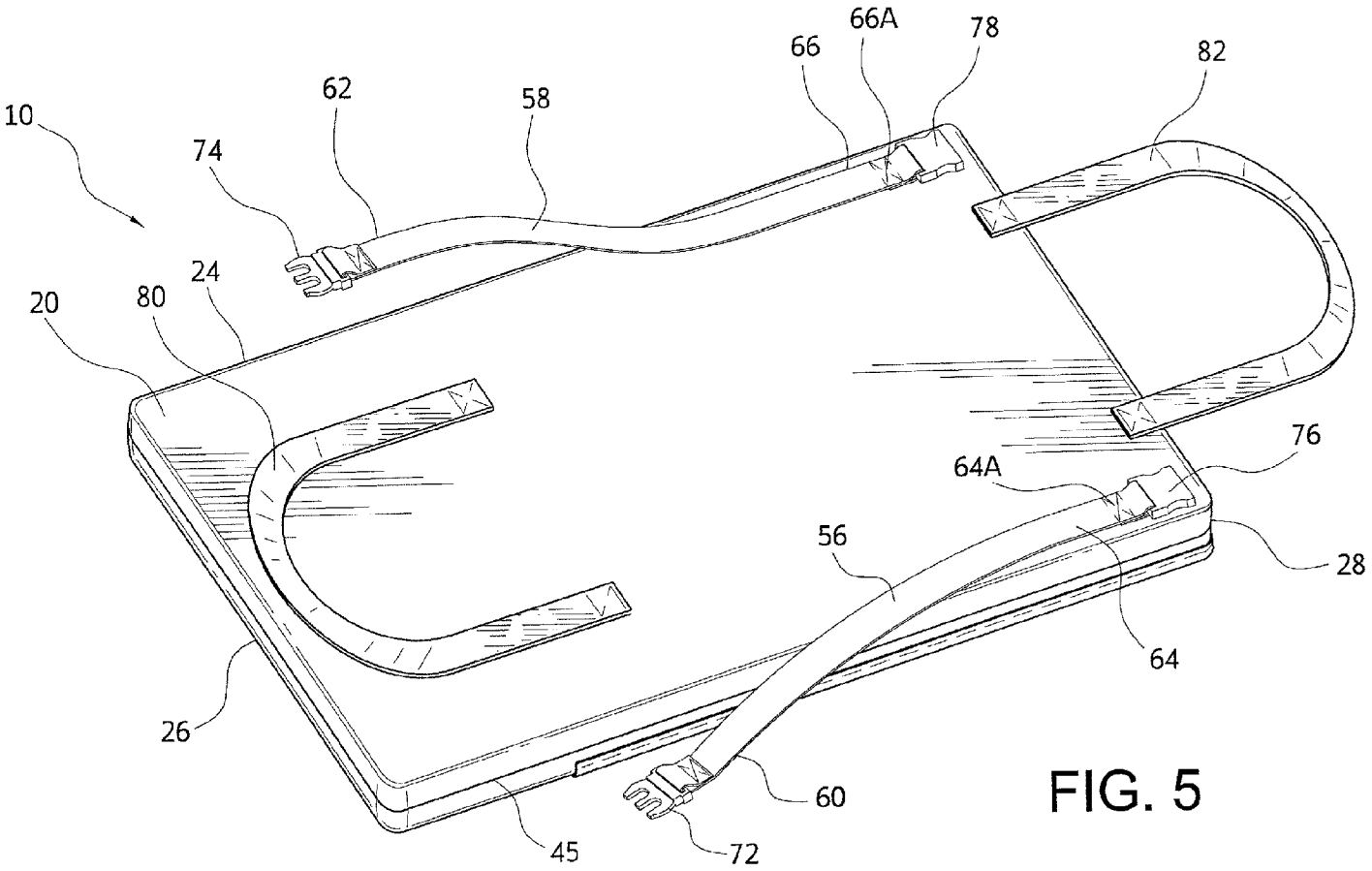
FIG. 5 a bottom perspective view of the portable sleeping assembly shown with reference to FIG. 1.

In accordance with an alternate embodiment, and with reference to FIG. 2, blanket 14 may be secured along a short portion of the second long side wall 24 adjacent the foot end 32 of the mat member 12. This will create an even more encased feeling at the foot end 32 of the mat member 12 in a manner replicating a sleeping bag.

With the first and second edges 48, 50 of the blanket 14 secured to the cover member 36 a comfortable pocket is created into which an individual can slide when it is time to go to sleep. However, and in contrast to other portable sleeping devices, the blanket 14 fully extends across and beyond the second long side wall 24 so as to cover the individual without creating chamber that decreases in width as the user slides in.

The portable sleeping assembly 10 also includes straps for storage and carrying. These straps are secured to the cover member 36 along the lower surface 20 of the mat member 12. In particular, the portable sleeping assembly 10 is provided with first and second closure straps 56, 58. With particular, reference to FIGS. 5 and 6, the first and second closure straps 56, 58 extend lengthwise, that is, parallel to the first and second long side walls 22, 24, and are secured to the cover member 36 of the mat member 12 at respective positions adjacent the first long side wall 22 and the second long side wall 24.

Each of the first and second closure straps 56, 58 includes a first end 60, 62 and a second end 64, 66. The first and second closure straps 56, 58 adjacent the second ends 64, 66 thereof are fixedly secured to the cover member 36 adjacent the foot end 32 of the mat member 12, while the first ends 60, 62 are free to be manipulated for secure closure of the mat member 12 after it has been rolled up. With this in mind, the first ends 60, 62 and the second ends 64, 66 are provided with mating fastening members 72, 74, 76, 78. It is appreciated that the location of the secured portions 64*a*, 66*a* allows the mat member 12 to be rolled up from the head end 30 toward the foot end 32 such that once the mat member 12 is fully rolled the first and second ends 60, 62, 64, 66 will align for selective attachment of the fastening members 72, 74, 76, 78.

In practice, and with the upper surface 18 facing upward and the lower surface 20 sitting upon a supporting surface, the blanket 14 is folded so that it sits completely upon the mat member 12. With none of the blanket 14 hanging over the mat member 12, the mat member 12 is rolled up in a direction from the head end 30 to the foot end 32. After the mat member 12 has been rolled the fastening members 72, 74, 76, 78 at the first and second ends 60, 62, 64, 66 of the first and second closure straps 56, 58 may be secured to hold the mat member 12 in the rolled up configuration.

Figure 6:
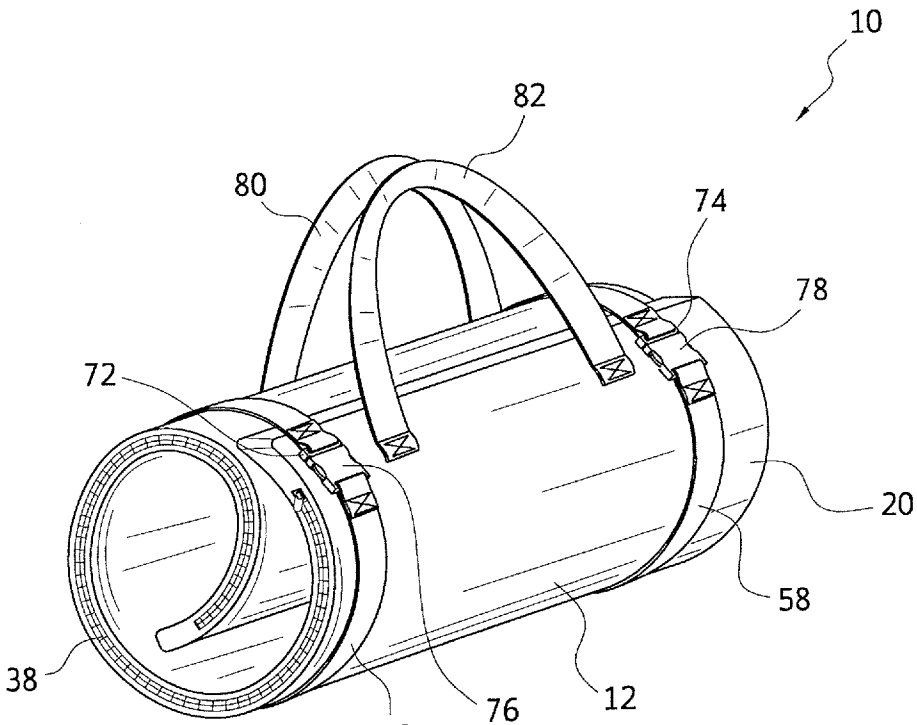
FIG. 6 a perspective view of the portable sleeping assembly rolled up in its storage configuration.
Figure 7:
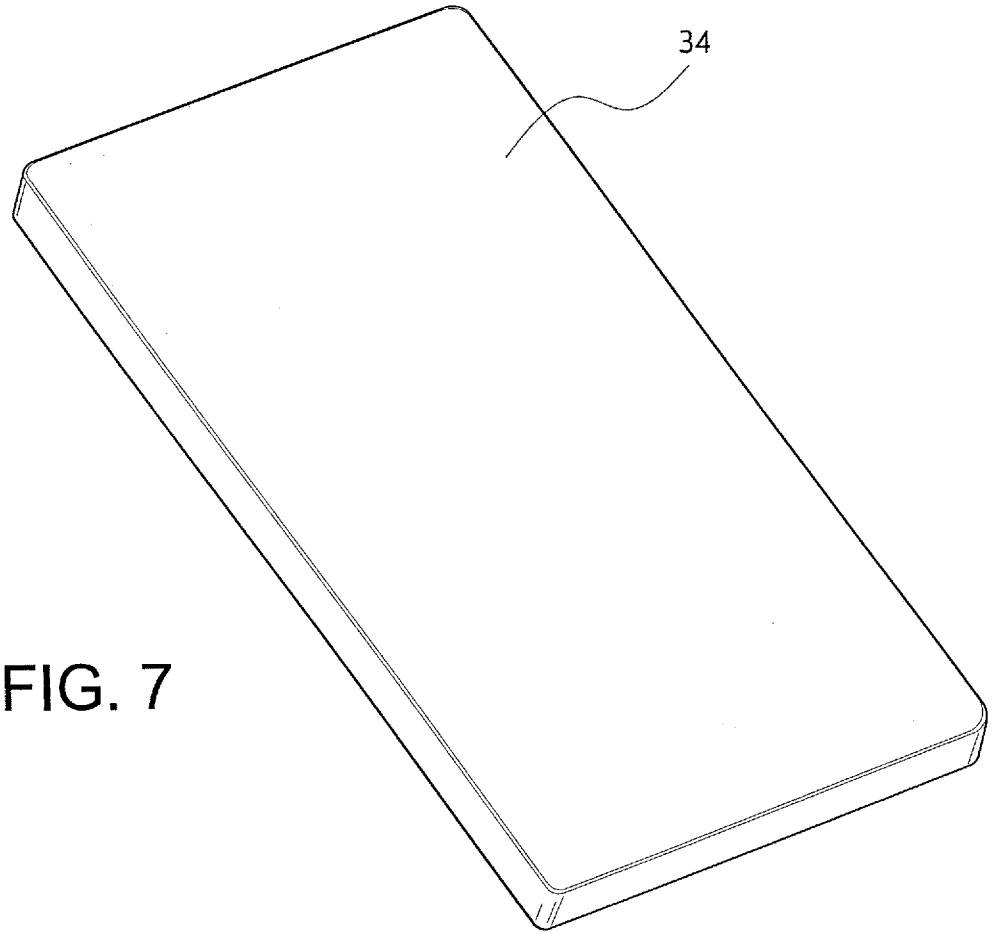
FIG. 7 is a perspective view of the foam core.
Figure 8:
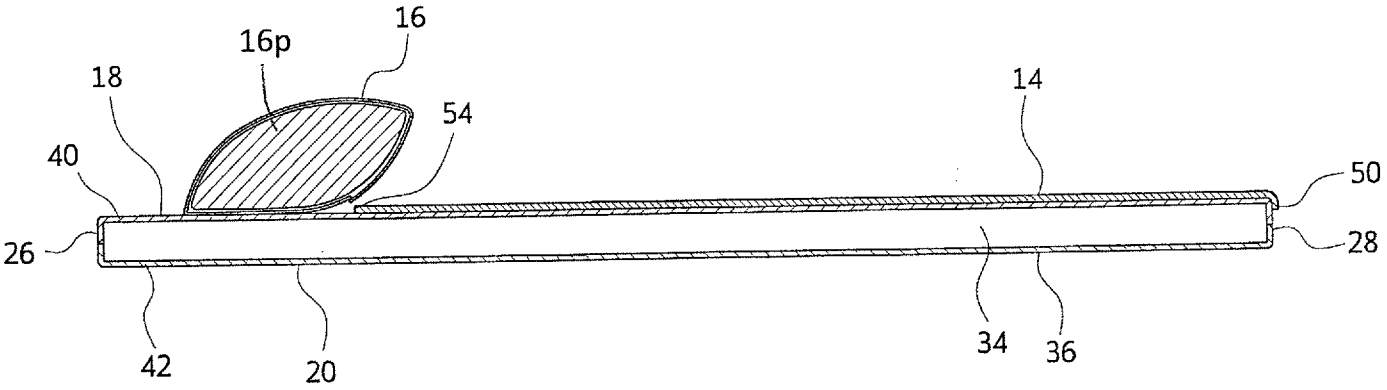
FIGS. 8 and 9 are respectively cross sectional views along the lines 8-8 and 9-9 in FIG. 3.
Figure 9:
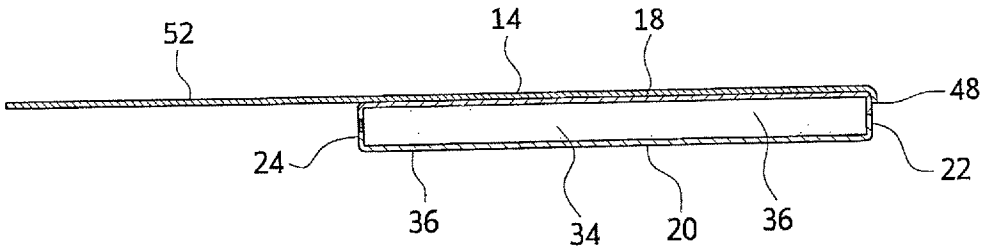

Carrying of the portable sleeping assembly 10 is facilitated with the provision of carry straps 80, 82 at the head end 30 and the foot end 32 of the mat member 12 along the lower surface 20 thereof. These carry straps 80, 82 are positioned such that they define loops that may be used in much the same manner as the shoulder straps of a backpack. Alignment of the carrying straps is further coordinated by proper positioning along the lower surface 20 of the mat member 12. In particular, the carry strap 82 at the foot end 32 of the mat member 12 is positioned directly adjacent the second short side wall 28 at the foot end 32 thereof. However, the carry strap 80 at the head end 30 of the mat member 12 is positioned a distance away from the first short side wall 26 at position between the first short side wall and the center of the mat member 12. By position the carry straps 80, 82 in this way, the carry straps 80, 82 will align as shown in FIG. 6 when the portable sleeping assembly 10 is rolled for storage and/or carrying.

While the preferred embodiments have been shown and described, it will be understood that there is no intent to limit the invention by such disclosure, but rather, is intended to cover all modifications and alternate constructions falling within the spirit and scope of the invention.

We claim:

1. A portable sleeping assembly comprising:

a mat member including a removable foam core, the mat member having a top and a bottom and four sides extending between the top and bottom, two of the four sides being short sides opposed from one another and the other two sides being opposed long sides which are longer in length than the short sides;

the mat member including a closable slot permitting the foam core to be inserted and removed from the mat member;

a minky fleece blanket permanently secured to the mat member only along two adjacent sides of the mat member, the blanket includes four edges, an upper surface and a lower surface, two adjacent edges of the blanket are respectively permanently secured to one of the long sides of the mat member and one of the short sides of the mat member and the edge of the blanket secured to the one of the short sides of the mat member is substantially longer than the short sides of the mat member and extends substantially beyond the short sides of the mat so as to form a free edge not secured to the mat so as to create a chamber which would not decrease in width when a user slides in;

a pillow pocket secured to the top of the mat member; and at least one closure strap secured to the bottom of the mat member.

2. The portable sleeping assembly of claim 1, wherein a pillow is positioned within the pillow pocket.

3. The portable sleeping assembly of claim 1, wherein the top of the mat member is made from a first material and the bottom of the mat member is made from a different second material.

4. The portable sleeping assembly of claim 3, wherein the first material is minky fleece and the different second material is rip-stop nylon.

5. The portable sleeping assembly of claim 1, wherein the removable foam core is memory foam.

6. The portable sleeping assembly of claim 1, wherein the slot is a zippered slot for opening and closing the slot.

7. The portable sleeping assembly of claim 1, wherein the bottom of the mat member further includes a pair of spaced carry straps defiling opposed loops.

8. The portable sleeping assembly of claim 1, wherein the at least one closure strap includes a first and second end having mating fasteners secured thereto.

9. The portable sleeping assembly of claim 1, wherein the pillow pocket is sewn to the top of the mat member.

10. A portable sleeping assembly comprising:

a mat member including a removable foam core, the mat member having a top and a bottom and four sides extending between the top and bottom, two of the four sides being short sides opposed from one another and the other two sides being opposed long sides which are longer in length than the short sides;

the mat member including a closable slot permitting the foam core to be inserted and removed from the mat member;

a minky fleece blanket fixedly secured via sewing to the mat member only along two adjacent sides of the mat member, the blanket includes four edges, an upper surface and a lower surface, two adjacent edges of the blanket are respectively fixedly secured to one of the long sides of the mat member and one of the short sides of the mat member and the edge of the blanket secured to the one of the short sides of the mat member is substantially longer than the short sides of the mat member and extends substantially beyond the short sides of the mat so as to form a free edge not secured to the mat so as to create a chamber which would not decrease in width when a user slides in;

a pillow pocket secured to the top of the mat member; and at least one closure strap secured to the bottom of the mat member.

11. The portable sleeping assembly of claim 10, wherein a pillow is positioned within the pillow pocket.

12. The portable sleeping assembly of claim 10, wherein the removable foam core is memory foam.

13. The portable sleeping assembly of claim 10, wherein the bottom of the mat member further includes a pair of spaced carry straps defining opposed loops.

14. The portable sleeping assembly of claim 10, wherein the at least one closure strap includes a first and second end having mating fasteners secured thereto.

* * * * *